US007906471B2

(12) United States Patent
Wiedemann et al.

(10) Patent No.: US 7,906,471 B2
(45) Date of Patent: Mar. 15, 2011

(54) CLEANING COMPOSITIONS PACKAGED IN ETHOXYLATED POLYVINYLALCOHOL MATERIALS

(75) Inventors: Ralf Wiedemann, Griesheim (DE); Marcus Guzman, Leimen (DE); Roger Kaiser, Ludwigshafen (DE)

(73) Assignee: Reckitt Benckiser N.V., Hoofddorp (NL)

( * ) Notice: Subject to any disclaimer, the term of this patent is extended or adjusted under 35 U.S.C. 154(b) by 0 days.

(21) Appl. No.: 12/722,817

(22) Filed: Mar. 12, 2010

(65) Prior Publication Data

US 2010/0167974 A1 Jul. 1, 2010

Related U.S. Application Data

(60) Division of application No. 11/646,179, filed on Dec. 26, 2006, now Pat. No. 7,708,840, which is a continuation of application No. 10/399,278, filed as application No. PCT/GB01/04618 on Oct. 17, 2001, now abandoned.

(30) Foreign Application Priority Data

Oct. 18, 2000 (GB) ..... 0025540.6
Oct. 18, 2000 (GB) ..... 0025543.0

(51) Int. Cl.
*C11D 17/04* (2006.01)

(52) U.S. Cl. ..... 510/220; 510/406; 510/439

(58) Field of Classification Search ..... 510/220, 510/406, 439; 134/25.2
See application file for complete search history.

(56) References Cited

U.S. PATENT DOCUMENTS 4,033,894 A * 7/1977 McLaughlin et al. ..... 510/220
4,176,079 A * 11/1979 Guerry et al. ..... 510/392
4,369,281 A * 1/1983 Zimmermann et al. ..... 524/379

* cited by examiner

*Primary Examiner* — Lorna M Douyon
(74) *Attorney, Agent, or Firm* — Norris McLaughlin & Marcus, PA

(57) ABSTRACT

Use of a film forming material comprising an ethoxylated poly(vinylalcohol) for the manufacturing of water-soluble packaging for a detergent composition or related material.

6 Claims, No Drawings

CLEANING COMPOSITIONS PACKAGED IN ETHOXYLATED POLYVINYLALCOHOL MATERIALS

This application is a divisional of U.S. patent application Ser. No. 11/646,179, filed on Dec. 26, 2006, now U.S. Pat. No. 7,708,840), which is a continuation application of U.S. patent application Ser. No. 10/399,278, filed Nov. 7, 2003, now abandoned, which was filed as an application under 35 U.S.C. §371 of PCT/GB01/04618 filed Oct. 17, 2001, which claims priority to the Great Britain applications 0025540.6 filed Oct. 18, 2000 and 0025543.0 filed Oct. 18, 2000.

The present invention relates to water-soluble packages enclosing compositions such as detergent compositions, preferably low-foaming compositions and related materials.

It is known to package detergents or related materials in containers or sachets of water-soluble or water-dispersible film material, in particular to avoid direct contact of the hazardous or irritant detergent material with the consumers' skin. Moreover, dosage is easier with portioned material, and it can simply be added to water in order to release the contents of the container or sachet into the water during usage.

CA-A-1,112,543 discloses a package made of water-soluble material in film form enclosing within it a paste-form, automatic dishwasher-compatible detergent composition. The water-soluble material may be, for example, poly (vinylalcohol), polyethylene oxide or methylcellulose. However, the performance of the different film-forming materials on usage with detergent material, and in particular in an environment such as an automatic dishwashing cycle, is sub-optimal.

It is therefore an object of the present invention to improve the performance of water-soluble polyvinylalcohol based materials when used to package compositions preferably low-foaming compositions such as detergents, in particular automatic dishwashing detergents.

We have now surprisingly discovered that ethoxylated poly (vinylalcohols), i.e. materials obtainable by grafting ethylene oxide on at least some of the hydroxyl groups of poly (vinylalcohol), provide significantly improved characteristics for the indicated purposes in several aspects.

The present invention accordingly provides a water-soluble package comprising an ethoxylated poly (vinylalcohol) enclosing a composition, preferably a low-foaming composition.

The present invention also provides the use of an ethoxylated poly (vinylalcohol) to enclose a composition, preferably a low-foaming composition.

The ethoxylated poly (vinylalcohol) may be in the form of a film. In this case it is desirably thermoformed to form the package. Thermoforming is desirably carried out under a controlled relative humidity of 35 to 40%. Further details may be found in WO 92/17382. It may also be subjected to vertical form fill sealing or extended tube filling processing.

Preferably, the film consists essentially of the ethoxylated poly (vinylalcohol).

The film may be laminated to one or more further film layers. Further details may be found in GB-A-2244258.

The ethoxylated poly (vinylalcohol) may also be injection moulded or blow moulded.

The composition may, for example, be a detergent composition, rinse aid, water-softening, disinfectant, antibacterial or antiseptic composition or a refill composition for a trigger-type spray or a hard surface cleaner.

In one alternative, the detergent composition is suitable for use in an automatic dishwashing machine.

In another alternative, the detergent composition is suitable for use in a laundry machine.

It is particularly preferred that either the detergent composition comprises at least one borate compound or that the package is intended to be brought into contact with borate compounds on usage.

The ethoxylated poly (vinylalcohols) are, for example, are those described in Wu, Zhining, Yang, Jinzong: "Heterophasic ethoxylation of poly (vinylalcohol)", Gaofenzi Xuebao (1995), (3), 296-301 (Abstract: CAPLUS 1995:716383).

For example, a preferred polymer to be used in the present invention is the ethylene oxide grafted poly (vinylalcohol) identified by CAS No. 146168-57-2, available under the tradename SOKALAN ES 95014 from BASF.

Besides their known good water-solubility, we have discovered surprising performance characteristics of these specifically modified poly (vinylalcohols) which make them unexpectedly superior for use in the present invention.

An important performance characteristic for the use of water-soluble materials in the packaging of low-foaming compositions is the foaming profile of the packaging material itself. It has now been surprisingly found that the specific material of the invention shows superior low foaming properties which make it optimal for packaging low-foaming compositions.

Another unexpected feature is a very high borate compatibility which is of significant importance for packaging detergent material, as either the detergent material itself may contain borates (for example in the case of an automatic dishwashing detergent) or will be brought into contact with borates in usage, i.e. in the washing liquor (for example in the case of a water-softener composition). For known poly (vinylalcohol) films, when used for packaging borate containing detergent material, the substantial decrease of the solubility of the poly (vinylalcohol) in water due to the complexing (and thus cross-linking) of the polymer by the borate has been a disadvantage.

A specific problem in some thermoforming is a certain degree of recovery of the material after the forming process which sometimes is undesired, i.e. when it is not intended to package the material very tightly. The specific film materials described in the present invention do not show any significant recovery.

A desired feature when making water-soluble packages is to avoid pinholes in the film through which leakage of the contained composition may occur. It may therefore be appropriate to use the film material of the invention as part of a laminate of two or more layers, as pinholes are unlikely to coincide in two layers of material.

The nature of the composition to be packaged in the invention is not limited. It may, for example, be a solid or a liquid. If it is in the form of a solid it may, for example, be in the form of a powder, granules, an extruded tablet, a compressed tablet or a solidified gel. If it is in the form of a liquid it may optionally be thickened or gelled with a thickener or a gelling agent. One or more than one phase may be present. For example the container may be filled with a liquid composition and a separate solid composition, for example in the form of a ball or pill. Alternatively two or more solid phases may be present, or two or more immiscible liquid phases.

If the water-soluble container is soluble in cold water at room temperature (20° C.) or slightly above, it is important to ensure that the composition itself does not dissolve the container. In general solid compositions will not attack the container, and neither will liquid compositions which contain less than around 5% of water, as described, for example, in WO 92/17382. If the composition is in the form of a liquid containing more than about 5 wt % water, action must be taken to ensure that the composition does not attack the walls of the container. Steps may be taken to treat the inside surface of the film, for example by coating it with an agent such as PVDC (poly (vinylidene chloride)) or PTFE (polytetrafluoroethylene), or to adapt the composition to ensure that it does not dissolve the film. For example, it has been found that ensuring the composition has a high ionic strength or contains an agent which minimises water loss through the walls of the container will prevent the composition from dissolving a PVOH film from the inside. This is described in more detail in EP-A-518,689 and WO 97/27743.

If more than one container is formed at the same time, the packaged compositions may then be separated from each other. Alternatively, they may be left conjoined and, for example, perforations provided between the individual containers so that they can be easily separated at a later stage, for example by a consumer.

If the containers are separated, the flanges may be left in place. However, desirably, the flanges are partially removed in order to provide an even more attractive, three-dimensional appearance. Generally the flange remaining should be as small as possible for aesthetic purposes while bearing in mind that some flange may be required, for example to ensure two films remain adhered to each other. A flange of 1 mm to 10 mm is desirable, preferably 2 mm to 8 mm, most preferably about 5 mm.

The containers of the present invention generally contain from 5 to 150 g of composition, such as an aqueous composition, especially from 15 to 40 g, depending on their intended use. For example, a dishwashing composition may weigh from 15 to 25 g, a water-softening composition may weigh from 25 to 35 g, and a laundry composition may weigh from 30 to 50 g.

The containers may have any shape. For example they can take the form of an envelope, sachet, sphere, cylinder, cube or cuboid, i.e. a rectangular parallelepiped whose faces are not all equal. If the container is formed from a thermoformed film and a planar film, the seam between the two films will appear nearer one face of the container rather than the other. Apart from the possible deformation of the container due to shrinkage of the PVOH film after the container is manufactured, deformation may also occur at the stage of manufacture if desired. For example, if the pocket is filled with a solid or gelled composition (for example in the form of a tablet having a height greater than that of the pocket), the second film will be deformed when placed on top of the pocket.

In general the maximum dimension of the filled part of the container (excluding any flanges) is 5 cm. For example, a rounded cuboid container may have a length of 1 to 5 cm, especially 3.5 to 4.5 cm, a width of 1.5 to 3.5 cm, especially 2 to 3 cm, and a height of 1 to 3 cm, especially 1.5 to 2.5 cm.

The composition filling the containers is not particularly limited. It can be any composition which is to be added to an aqueous system or used in an aqueous environment. For example, the composition may comprise a dishwashing, water-softening, laundry or detergent composition or a rinse aid. In this case it is especially suitable for use in a domestic washing machine such as a laundry washing machine or dishwashing machine. The container may also comprise a disinfectant, antibacterial or antiseptic composition intended to be diluted with water before use, a hard surface cleaner or a concentrated refill composition, for example for a trigger-type spray used in domestic situations. Such a composition can simply be added to the spray container and then water added.

The present invention is now further described in the following Examples.

EXAMPLES

Tests were conducted with the above-mentioned ethylene oxide grafted poly(vinylalcohol) SOKALAN ES 95014 obtainable from BASF. For the comparative tests, two other known poly(vinylalcohol) materials, namely HI-SELON C-200 (homopolymer), obtainable from Nippon Synthetic Chemical Industry Co., Osaka, Japan, and MONOSOL M8534 (copolymer) obtainable from Chris Craft Inc., Gary, Ind., U.S.A., were used.

Dissolution Speed

The dissolution speed of the different materials is determined by dropping portions of 70×60 $mm^2$ of an 80 micron thick film into 1 litre of distilled water maintained at a temperature of 20° C. and stirred at 200 rpm.

The times for complete dissolution for the different film materials are summarised in table 1.

TABLE 1

| | Dissolution time (min) |
|---|---|
| SOKALAN ES 95014 | 4 |
| HI-SELON C-200 | 28 |
| MONOSOL M8534 | 14 |

As can be seen from the results above, the material used in the invention is clearly superior to other poly(vinylalcohol) based film materials.

Borate Compatibility

For determining the borate compatibility of different film materials, 0.2 g of the different films (thickness: 100 μm) are dissolved in 1.000 ml of an aqueous solution containing 1.94 wt.-% sodium perborate monohydrate and 0.97 wt.-% sodium carbonate. The solution is stirred at 100 rpm, the temperature being 20° C. During the dissolution process the different films are in a spherical closed sieve with a diameter of about 5 cm. The holes of the sieve have a diameter of approx. 0.1 mm allowing an easy movement of the water through the container. After 30 min the sieve is taken out of the solution and is put into an oven at a temperature of 105° C. to dry the residues until constant weight is achieved. Afterwards the amount of undissolved film is determined gravimetrically.

After 30 min dissolution time the following results were obtained:

HI-SELON C-200: 0.195 g of undissolved film, nearly nothing dissolved (sticky and slimy residues before drying).

MONOSOL M8534: 0.064 g of undissolved film, approximately 75% dissolved.

SOKALAN ES 95014: no residues, completely dissolved.

An alternative test that can also be used to determine the borate compatibility of the different film materials is as follows, using a laundrymeter:

0.2 g of the different films (thickness: 100 μm) are added to 1.000 ml of an aqueous solution containing 1.94 wt. % sodium perborate monohydrate and 0.97 wt. % sodium carbonate. The solution is put into a laundrymeter and is constantly shaken at a temperature of 20° C. The solution also contains a sheet of black dyed fabric of dimensions 20×20 $cm^2$. After 30 min the sheet of fabric is checked visually for undissolved residues on the fabric surface.

The following results were obtained:

HI-SELON C-200: very high amount of sticky and slimy residues on the surface of the fabric.

MONOSOL M8534: high amount of sticky residues

SOKALAN ES 95014: no residues

As it will be seen from the results above the dissolution of the material intended for use in the invention is not affected by borate.

Foaming Properties

The volume of foam is measured after rotating a graded glass cylinder having a volume of 100 ml 50 times through an angle of 180°. The glass cylinder contains 50 ml of an aqueous solution of the respective poly(vinylalcohol) material. Results are presented in ml of foam left on top of the aqueous solution after the listed time periods and can be seen from the following Table 2.

TABLE 2

| | Start | 10 sec | 30 sec | 60 sec | 3 min | 5 min |
|---|---|---|---|---|---|---|
| 1% HI-SELONC-200: | 20 ml | 20 ml | 19 ml | 18 ml | 11 ml | 11 ml |
| 1% MONOSOL M8534: | 7 ml | 7 ml | 7 ml | 7 ml | 5 ml | 5 ml |
| 1% SOKALAN ES 95014: | 10 ml | 8 ml | 6 ml | 4 ml | 3 ml | 3 ml |

The low foaming behaviour of the material intended for use in the invention is clearly superior to that of the other materials.

Thermoforming Temperature

A Multivac thermoforming machine operating at 115 to 120° C. is used to thermoform a poly(vinylalcohol) film from the respective materials. Usually the forming temperature of poly(vinylalcohol) films is within that range. Surprisingly we have found that SOKALAN ES 95014 is already thermoformable at a lower temperature of 105° C., allowing the forming station to run at a lower temperature. In case of any temporary breakdown of the machine the film evaporates water, which results in a reduction of the plasticity of the film (the film gets brittle and non-homogenous). The lower necessary temperature of the forming tool reduces that risk.

Recovery Effect

To quantify the recovery effect of the different film materials a Multivac thermoforming machine operating at 115 to 120° C. is used to thermoform a poly(vinylalcohol) film from the respective materials. The thermoforming mould has the following dimensions:

Width: 28 mm

Length: 39 mm

Depth: 17 mm

The mould used had both rounded corners and edges and a total volume of 17.0 ml. The recovery effect of the respective materials is determined by measuring the difference between the mould volume and the volume of the formed pocket.

This determination of the volume of the formed pocket was done gravimetrically by filling oil into the formed pocket and weighing the ensemble. The results are average values of 10 measurements each and can be seen in table 3.

TABLE 3

| | Volume (ml) | Recovery (%) |
|---|---|---|
| SOKALAN ES 95014 | 16.95 | 0.3 |
| HI-SELON C-200 | 14.82 | 12.8 |
| MONOSOL M8534 | 10.58 | 37.8 |

No significant recovery effect can be seen when using SOKALAN ES 95014 in the thermoforming process, in contrast to the other two materials.

Transparency of Films

Another additional advantage of SOKALAN ES 95014 is its high transparency compared to the other materials. A spectral colorimeter (Metrohm E 1009) is used to determine the transmission of the different materials. Each film thickness is 80 microns. The results are shown in table 4.

TABLE 4

| | Transmission (%) at 650 mm |
|---|---|
| SOKALAN ES 95014 | 97 |
| HI-SELON C-200 | 86 |
| MONOSOL M8534 | 90 |

The features disclosed in the foregoing description, and/or in the claims may, both separately and in any combination thereof, be material for realising the invention in diverse forms thereof.

The invention claimed is:

1. A water-soluble package comprising a film consisting of an ethylene oxide grafted (polyvinylalcohol) material enclosing a low-foaming dishwasher detergent composition which comprises at least one borate compound enclosing a dishwasher detergent composition.

2. A package according to claim 1 wherein the composition is a rinse-aid, water-softening, disinfectant, antibacterial or antiseptic composition.

3. A package according to claim 1 wherein the detergent composition is suitable for use in an automatic dishwashing machine.

4. A package according to claim 1 wherein the package is formed by thermoforming the film.

5. A package according to claim 1, wherein the package is formed by injection moulding or blow-moulding the film.

6. A package according to claim 1 wherein the film is laminated to one or more further film layers.

* * * * *